US005758979A

United States Patent [19]

Chen

[11] Patent Number: 5,758,979

[45] Date of Patent: Jun. 2, 1998

[54] PRINTER CARTRIDGE RIBBON INKING SYSTEM

[76] Inventor: William T. Chen, 1540 New Haven Rd., Naugatuck, Conn. 06770

[21] Appl. No.: 741,533

[22] Filed: Oct. 31, 1996

Related U.S. Application Data

[63] Continuation of Ser. No. 498,895, Jul. 6, 1995, abandoned.

[51] Int. Cl.[6] ..... B41J 31/16

[52] U.S. Cl. ..... 400/197; 400/194

[58] Field of Search ..... 400/197, 200, 400/202, 202.1–202.4, 207, 196, 194

[56] References Cited

U.S. PATENT DOCUMENTS

| | | | |
|---|---|---|---|
| 2,471,238 | 5/1949 | Pelton | 400/202.3 |
| 4,690,576 | 9/1987 | Cory | 400/202.3 |
| 4,741,639 | 5/1988 | Fausto et al. | 400/197 |
| 5,218,905 | 6/1993 | Bolte et al. | 101/350 |
| 5,314,257 | 5/1994 | Cheng | 400/202.3 |

FOREIGN PATENT DOCUMENTS

| | | | |
|---|---|---|---|
| 0526119 | 2/1993 | European Pat. Off. | 400/202 |
| 0006171 | 1/1990 | Japan | 400/197 |

*Primary Examiner*—Edgar S. Burr
*Assistant Examiner*—Anthony H. Nguyen
*Attorney, Agent, or Firm*—St. Onge Steward Johnston & Reens LLC

[57] ABSTRACT

The inking mechanism of the present invention comprises one or more free-floating inking rollers which rotate within the housing of a printer cartridge between the inking brushes and the printer ribbon. While the rotation of the inking rollers is unlimited, the inking rollers are trapped between the inking brushes, the ribbon and the housing thereby limiting their freedom of movement. The free-floating aspect of the inking rollers provides a desirable pumping action against the inking brushes and the use of the inking brush, the ribbon, and the housing to trap the inking rollers eliminates the need for additional support structure.

11 Claims, 2 Drawing Sheets

PRINTER CARTRIDGE RIBBON INKING SYSTEM

This is a continuation application of application Ser. No. 08/498,895 filed on Jul. 6, 1995, now abandoned.

FIELD OF THE INVENTION

The invention relates to the field of printer ribbon cartridges wherein ink is applied to an endless ribbon.

BACKGROUND OF THE INVENTION

Printer ribbon cartridges for high speed printers are typically used with impact printers such as dot matrix printers. In some printer ribbon cartridge designs, the endless ribbon is lead around fixed support rollers and is continuously inked by a brush. The ink is fed by gravity and capillary action from an inkwell or from a reservoir containing a hard felt mat through a felt wick to a brush that presses against a roller wheel used to advance the ribbon or against a fixed support roller. The brush maintains a constant force on the roller and ink is transferred onto the surface of the roller as the roller rotates against the brush. The ink is thereafter transferred to the endless ribbon.

It has been found, however, that gravity and capillary action are not always sufficient to feed ink to the wick and onto the brush. Other designs have sought to overcome this problem by varying the force with which the roller presses against the brush. This causes a pumping action which facilitates the transfer of ink onto the roller and encourages ink to flow into the brush.

In addition to fixed support rollers found in other prior art designs, cartridges that employ a pumping action have additional components, such as independent, movable inking rollers and support structures therefor. In these prior art designs, the inking roller remains in contact with the brush at all times but is moveable with respect thereto, such that the pressure exerted by the inking roller on the brush may vary. For example, when the ribbon is advanced, the inking roller rotates against the brush and simultaneously increases pressure against the brush, thereby compressing the brush to release ink onto the inking roller. When the ribbon stops, the inking roller decreases pressure against the brush, thereby allowing the brush to re-expand and re-saturate with ink. The ink deposited on the inking roller is transferred onto the endless ribbon, or onto another element, such as an intermediary belt, which then transfers the ink onto the endless ribbon. See U.S. Pat. No. 5,054,943 and U.S. Pat. No. 5,314,257.

In these prior designs, however, it has been found that the additional elements required (e.g. the independent, movable inking rollers and support structure therefor) may increase the costs of materials and manufacturing of the ink cartridge and may decrease their reliability.

What is desired, therefore, is an ink cartridge with and endless ribbon which employs an inking mechanism with a pumping action to facilitate the transfer of ink onto the ribbon, and which uses a minimum number of additional components.

SUMMARY OF THE INVENTION

Accordingly, it is an object of the invention to provide an inking mechanism that employs a pumping action to facilitate the transfer of ink onto an endless ribbon.

It is another object of the invention to provide an inking mechanism of the above characteristics which includes one or more free-floating inking rollers.

It is a further object of the invention is to provide an inking mechanism of the above characteristics which reduces the need for additional components or support structure for the inking rollers.

Still another object of the invention is to provide an inking mechanism of the above characteristics wherein the free-floating inking rollers bear against an inking brush and are held in place by the brush, the ribbon, and the housing of the printer cartridge.

The inking mechanism of the present invention comprises a housing, at least one inking brush, at least one inking roller in contact with the brush, and an endless ribbon in contact with the inking roller. The inking roller is somewhat free-floating in that it does not have a fixed axis of rotation.

Although the inking roller does not have a fixed axis of rotation, it is confined within a certain area by the ribbon, the brush and the housing. The ribbon is lead around the inking roller and the brush is placed such that it is in direct contact with the inking roller between the incoming and outgoing ends of the ribbon. Thus, the inking roller is urged against the brush by the tension in the ribbon. The brush is aligned such that it is off-center with respect to the incoming and outgoing ends of the ribbon, and therefore the tension in the ribbon also tends to urge the inking roller to slide sideways, off the brush. However, the housing prohibits the inking roller from sliding off of the brush by limiting its movement. Therefore, the inking roller may translate (and rotate) within an area defined by the ribbon, the brush and the housing.

The periodic advancement of the ribbon increases both the tension in the ribbon and the force that the ribbon applies to the inking roller. Since the inking roller of the present invention may move relative to the brush, the force applied to the inking roller by the tension in the ribbon is transferred to the brush, creating a desirable pumping action. Also, since the inking mechanism of the present invention employs the use the ribbon the brush and the housing as support structures for the movable inking rollers, the need for additional support structure present in prior art designs has been avoided.

The invention and its particular features and advantages will become more apparent from the following detailed description considered with reference to the accompanying drawings.

DETAILED DESCRIPTION OF THE INVENTION

Figure 1:
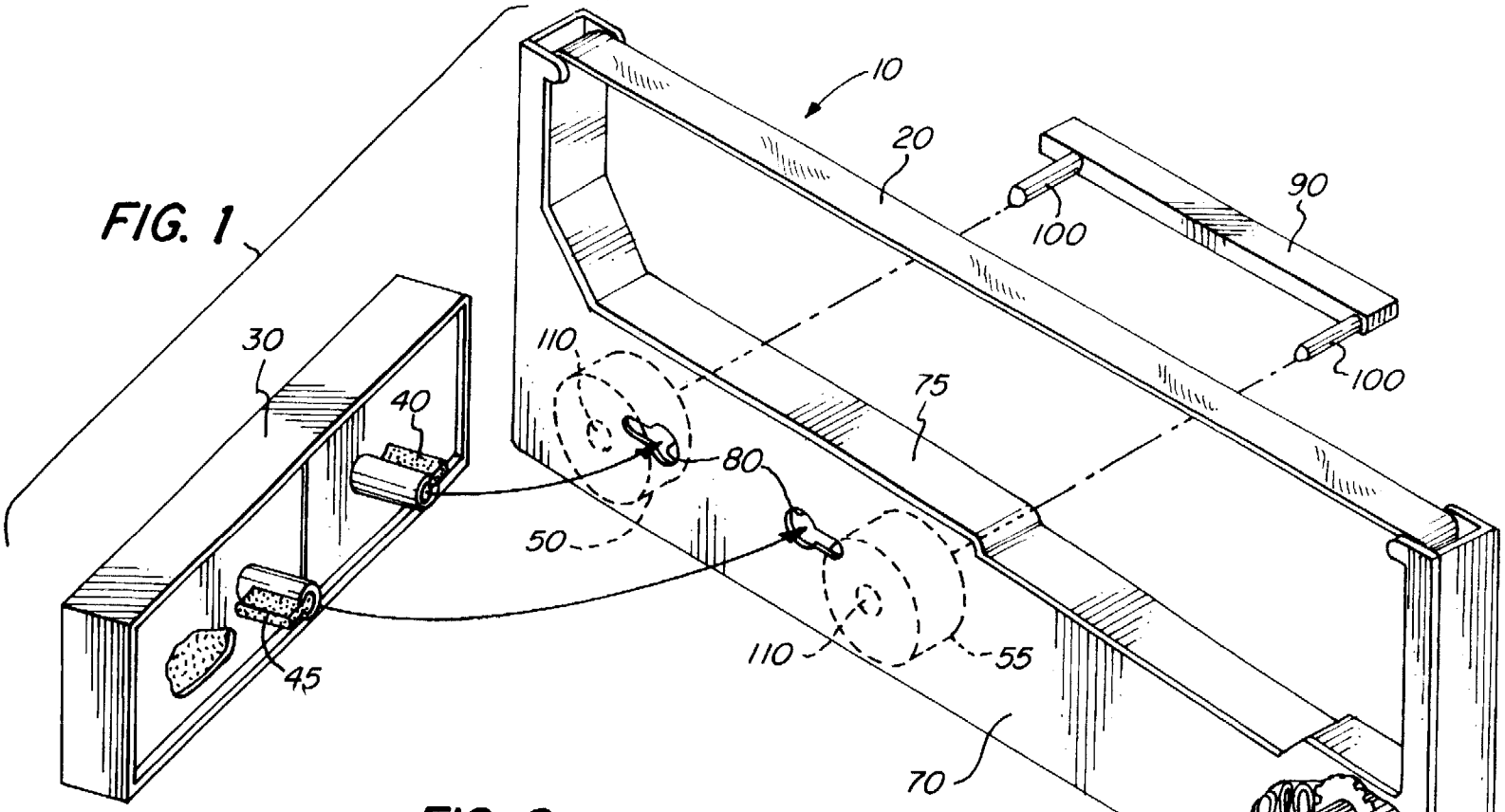
FIG. 1 is an exploded, perspective view of a printer cartridge in accordance with the present invention, with a cut-away showing added detail.
Figure 2:
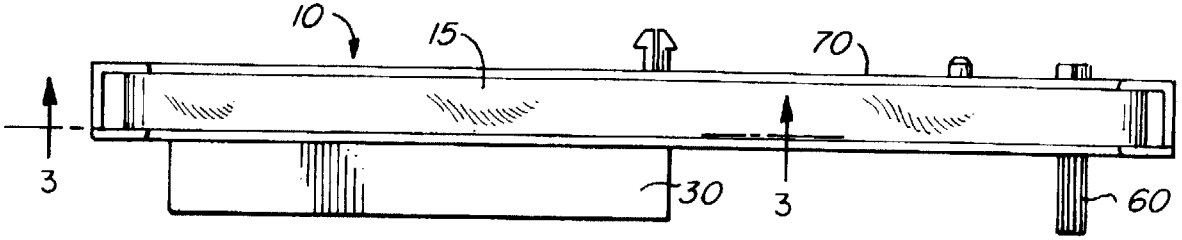
FIG. 2 is a side, cross-sectional view of the printer cartridge of FIG. 1.

Referring to FIG. 1 and 2, the printer cartridge 10 includes an endless ribbon 20, at least one inkwell 30, one or more brushes 40, 45, one or more inking rollers 50, 55 a ribbon advance mechanism 60, and a housing 70 having walls 75. When assembled, the brushes 40, 45 extend through holes 80 in the housing 70 and are located adjacent the inking rollers 50, 55. Prior to use, the inking rollers 50, 55 may be held away from the brushes 40 by a separator 90 having pins 100 which communicate with the center holes 110 of the inking rollers 50.

Figure 3:
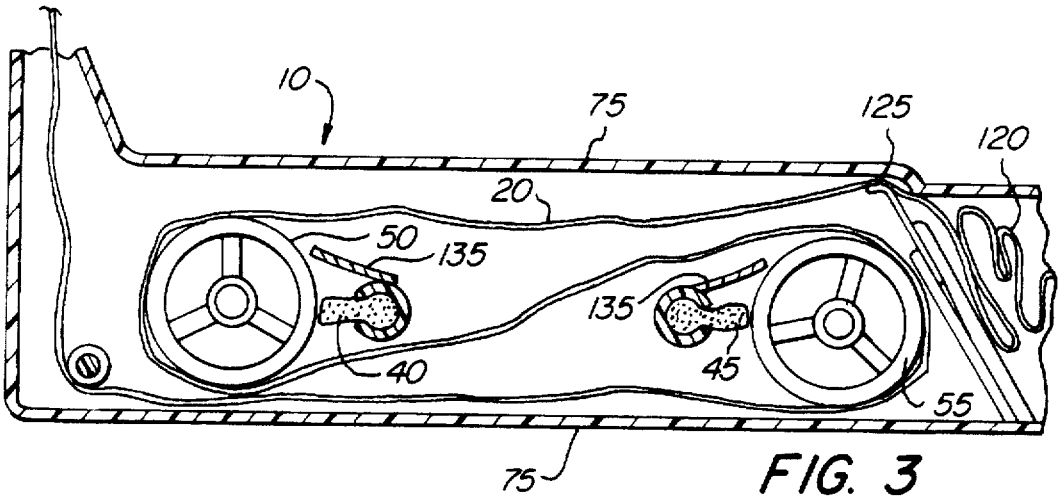
FIG. 3 is a top, cross-sectional view of the printer cartridge of FIG. 1 showing the inking mechanism and ribbon in a slack position.

Referring to FIG. 3, the endless ribbon 20 is lead from a ribbon storage area 120, through a tensioning means 125, around a first inking roller 50, between two brushes 40, 45, and around a second inking roller 55. The inking rollers 50, 55 do not have a fixed axis of rotation, but the translational movement of the inking rollers 50, 55 is limited by the housing walls 75, the ribbon 20, and the brushes 40, 45. The tensioning means 125 described above may be any suitable means to maintain tension in the ribbon. The tensioning means 125 is disclosed as a strip of metal which traps the ribbon 20 against the wall 75 of the housing 70, however, other means such as one or more rollers would also be within the scope of the present invention. In this FIG. 3, the ribbon advancement mechanism 60 (not shown) is not activated, therefor, the ribbon 20 is slack.

Figure 4:
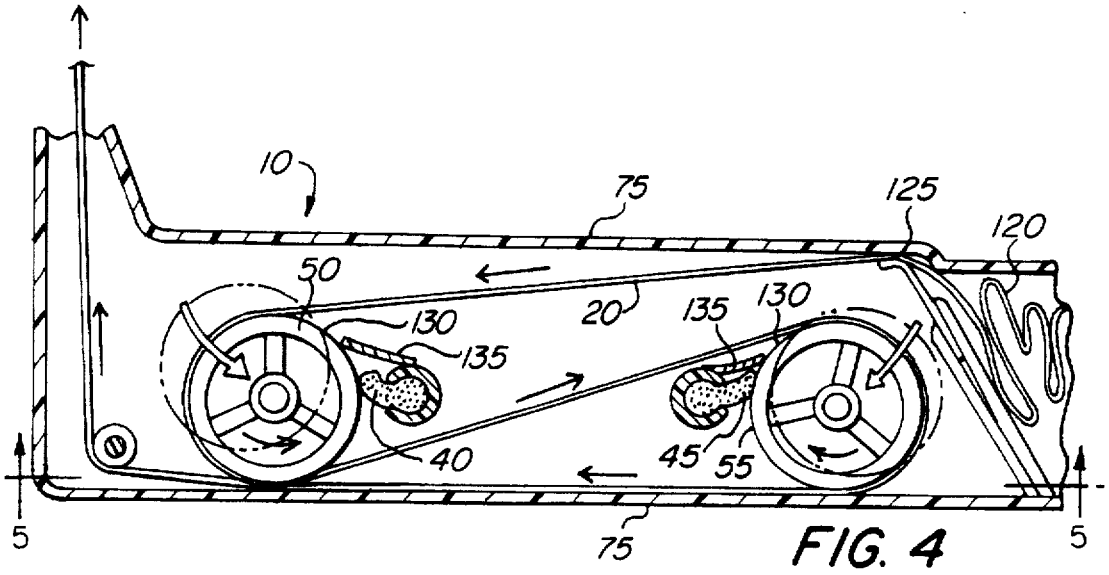
FIG. 4 is a top, cross-sectional view of the printer cartridge of FIG. 1 showing the inking mechanism and ribbon in a taut position.
Figure 5:
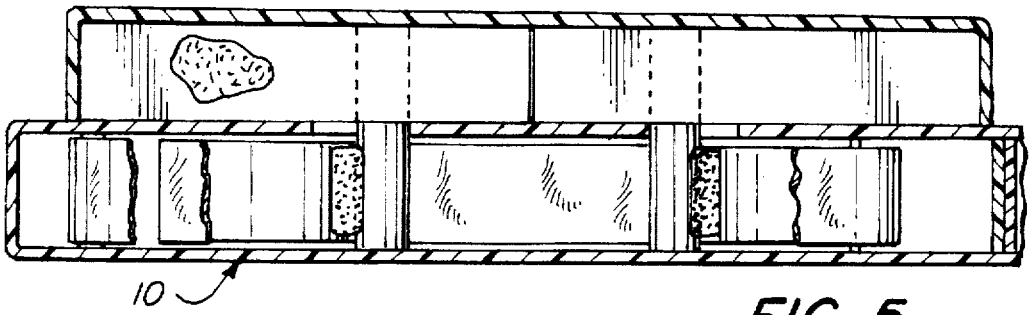
FIG. 5 is a side view of the printer cartridge of FIG. 1.

Referring to FIG. 4, the ribbon advance mechanism 60 (not shown) is activated causing the ribbon 20 to advance and become taut. Tension in the ribbon 20 is created by the ribbon advance mechanism 60 and the tensioning means 125. This tension urges the inking rollers 50, 55 towards one another and against their respective brushes 40, 45. Also, the movement of the ribbon urges the inking rollers 50, 55 to rotate against the brushes 40, 45, picking up ink 130 therefrom. The inking rollers 50, 55 are also urged toward the housing walls 75 by both the tension in the ribbon 20 and the rotation of the inking rollers 50, 55.

Preferably, the distance between the brushes 40, 45 and the housing wall 75 is less than the diameter of the inking rollers 50, 55 such that the inking rollers 50, 55 will not fit therebetween. Thus, when the ribbon 20 is taut and moving, the inking rollers are effectively constrained by the ribbon 20, the brushes 40, 45 and the hosing walls 75.

Referring to FIG. 3 and 4, when the ribbon 20 is advancing (as shown in FIG. 4.), the tension in the ribbon 20 increases and causes the inking rollers 50, 55 to compress against the brushes 40, 45. When the ribbon 20 is stationary (as shown in FIG. 3), the tension decreases and the inking rollers 50, 55 may move away from the brushes 40, 45 and thereby allow the brushes 40, 45 to expand and draw ink from the ink well 30 (not shown). This compression/expansion action provides the desirable pumping action which aids in the transfer and replenishment of ink.

Also, wiper means 135 are preferably provided to even out, smooth, and reduce the thickness of the ink film 130 deposited onto the rollers 50, 55 by the brushes 40, 45 prior to the surface of the rollers 50, 55 contacting the ribbon 20.

Referring again to FIG. 4, preferably the distance between the brushes 40, 45 and the housing walls 75 is less than the diameter of the inking rollers 50, 55 such that the housing walls 75 are used to limit the translation of the inking rollers 50, 55. In other embodiments, however, this may be accomplished by other means and still be within the spirit of the present invention. For example, the housing 70 may include slots (not shown anywhere) which communicate with axles of the inking rollers 50, 55, thereby limiting the translation of the inking rollers 50, 55 along one or more axis. Alternatively, the housing 70 may include ridges (not shown anywhere) which contact the ribbon 20 around the inking rollers 50, 55 or which contact the inking rollers 50, 55 directly, thereby limiting the translation of the inking rollers 50, 55.

Also, it should be appreciated that the use of a different number of free-floating inking rollers (other than two as shown in FIG. 3, and FIG. 4) is still within the spirit of the invention. For example, a third or fourth free-floating inking roller could be employed, and, alternatively, one of the two free-floating inking rollers could be replaced by a fixed, support roller, or a post around which the ribbon moves.

Although the invention has been described with reference to a particular arrangement of parts, features and the like, these are not intended to exhaust all possible arrangements or features, and indeed many other modifications and variations will be ascertainable to those of skill in the art.

What is claimed is:

1. An apparatus for applying ink, comprising:

a housing;

a source of ink;

at least one ink applicator in an operable relationship with said source of ink;

a free-floating, unattached inking roller located within said housing for receiving ink from said ink applicator;

a ribbon disposed around said free-floating inking roller for receiving ink from said free-floating inking roller, the advancement of said ribbon providing tension in said ribbon which causes said inking roller to contact and roll against said ink applicator to facilitate transfer of ink onto said ribbon; and said free-floating inking roller having a diameter larger than a distance between said ink applicator and a portion of said housing, whereby transactional movement of said free-floating, unattached inking roller is constrained by the ribbon in combination with the inability of the ink roller to fit between said ink applicator and said portion of said housing.

2. The inking apparatus of claim 1, further comprising a ribbon advancing member for advancing said ribbon.

3. The inking apparatus of claim 1, further comprising a tension member for providing tension in said ribbon.

4. The inking apparatus of claim 1, further comprising an ink smoothing member in an operable relationship with said ink applicator for providing a substantially evenly distributed film of ink onto said free-floating inking roller.

5. An apparatus for applying ink, comprising:

a housing with a ribbon storage area;

a removable source of ink;

more than one ink applicator in an operable relationship with said source of ink;

free-floating, unattached inking rollers located within said housing for receiving ink from said ink applicators;

a ribbon disposed around said free-floating inking rollers for receiving ink from said free-floating inking rollers, the advancement of said ribbon providing tension in said ribbon which causes said inking rollers to contact and roll against said ink applicators to facilitate transfer of ink onto said ribbon; and said free-floating inking rollers each having a diameter larger than a distance between said ink applicators and a portion of said housing, whereby transactional movement of said free-floating, unattached inking rollers are constrained by the ribbon in combination with the inability of the ink rollers to fit between said ink applicators and said portion of said housing.

6. The inking apparatus of claim 5, further comprising a ribbon advancing member for advancing said ribbon.

7. The inking apparatus of claim 5, further comprising a tension member for providing tension in said ribbon.

8. The inking apparatus of claim 5, further comprising ink smoothing members in operable relationship with said ink applicators for providing a substantially evenly distributed film of ink onto said free-floating inking rollers.

9. A method of applying ink to a ribbon in a printer cartridge, comprising the steps of:

providing a source of ink;

providing at least one ink applicator in an operable relationship with said source of ink;

providing a free-floating, unattached inking roller within the printer cartridge for receiving ink from said ink applicator, the inking roller having a diameter smaller than a distance between said ink applicator and a portion of said cartridge;

disposing said ribbon around said free-floating inking roller for receiving ink from said free-floating inking roller, so that the translational movement of said free-floating, unattached inking roller is restricted by said ribbon in combination with the inability of said inking roller to fit between said ink applicator and said portion of said cartridge; and advancing said ribbon to cause said inking roller to contact and roll against said ink applicator to facilitate transfer of ink onto said ribbon.

10. The method of claim 9, wherein the ribbon advancement is performed by a ribbon advancing member.

11. The method of claim 9, further comprising the step of providing a substantially evenly distributed film of ink onto said free-floating inking roller.

* * * * *